United States Patent [19]

Someya

[11] Patent Number: 5,006,866

[45] Date of Patent: Apr. 9, 1991

[54] THERMAL PRINTING APPARATUS RESPONSIVE TO ESTIMATED STORED HEAT OF THE HEATING ELEMENT

[75] Inventor: Akihiko Someya, Kanagawa, Japan

[73] Assignee: Kabushiki Kaisha Toshiba, Kawasaki, Japan

[21] Appl. No.: 420,824

[22] Filed: Oct. 12, 1989

[30] Foreign Application Priority Data

Oct. 31, 1988 [JP] Japan ..... 63-275221

[51] Int. Cl.[5] ..... Q01D 15/10

[52] U.S. Cl. ..... 346/76 PH; 400/120

[58] Field of Search ..... 346/1.1, 76 PH; 400/120

[56] References Cited

U.S. PATENT DOCUMENTS 4,514,738 4/1985 Nagato et al. ..... 346/76 PH

FOREIGN PATENT DOCUMENTS 0149369 7/1986 Japan ..... 346/76 PH

*Primary Examiner*—Mark J. Reinhart
*Assistant Examiner*—Huan Tran
*Attorney, Agent, or Firm*—Foley & Lardner

[57] ABSTRACT

A thermal printing apparatus comprises a thermal head which has a plurality of heat generating elements to generate a heat according to an image. A temperature of the thermal head is detected by a thermister. The thermal head is controlled by a thermal head controlling circuit which comprises a heat storage computing circuit for estimating a stored heat in the thermal head after the present driving signal will be supplied to the thermal head to generate heat. The pulse width of the driving signal is varied using the detected temperature of the thermal head, the modified pulse width and the estimated stored heat as the stored heat in the thermal head is increasing or decreasing during printing the present element.

11 Claims, 11 Drawing Sheets

THERMAL PRINTING APPARATUS RESPONSIVE TO ESTIMATED STORED HEAT OF THE HEATING ELEMENT

BACKGROUND OF THE INVENTION

1. Field of the Invention

The present invention relates to a thermal printing apparatus, especially a thermal printing apparatus for an half tone image which compensates for the effect of heat storage.

2. Description of the Related Art

U.S. Pat. No. 4,514,738 discloses a thermal printing apparatus which improves image quality of an half tone image by predicting heat stored in a thermal head, which use heat to produce a print.

The prior art apparatus may print a good quality half image under ideal conditions. The prior art apparatus, however, may fail to print a good half image in an actual use, e.g., in the most offices.

SUMMARY OF THE INVENTION

Accordingly, it is an object of the present invention to provide a thermal printing apparatus which may produce a good quality half tone image under a wilder variety of conditions.

In accordance with the present invention, the foregoing object, among others, is achieved by providing a thermal printing apparatus which may predict an estimated heat stored in a thermal head using a temperature of the thermal head. In more detail, the thermal printing apparatus generates heat to produce an output image according to an input image. The thermal printing apparatus includes driving means for supplying a driving signal corresponding to the input image. The thermal head comprising a base and a heating element array on the base, responsive to an input signal, for generating heat to produce the output image. First generating means generates a temperature signal representative of a temperature of the base. In response to the temperature signal, predicting means generates an estimated stored heat signal representative of an estimated stored heat in the array means after the driving means supplies the driving signal. In response to the driving signal and the estimated stored heat signal, controlling means generates the input signal.

Other objects, features, and advantages of the present invention will become apparent from the following detailed description. It should be understood, however, that the detailed description and specific examples while indicating preferred embodiments of the invention, are given by way of illustration only, since various changes and modificatives within the spirit and scope of the invention will become apparent to those skilled in the art from this detailed description.

BRIEF DESCRIPTION OF THE DRAWINGS

Other objects and many of the attendant advantages of this invention will be readily appreciated as the same becomes better understood by reference to the following detailed description when considered in connection with the accompanying drawings, in which like reference characters designate the same or similar parts throughout the figures thereof and wherein.

DETAILED DESCRIPTION OF THE PREFERRED EMBODIMENTS

Figure 1:
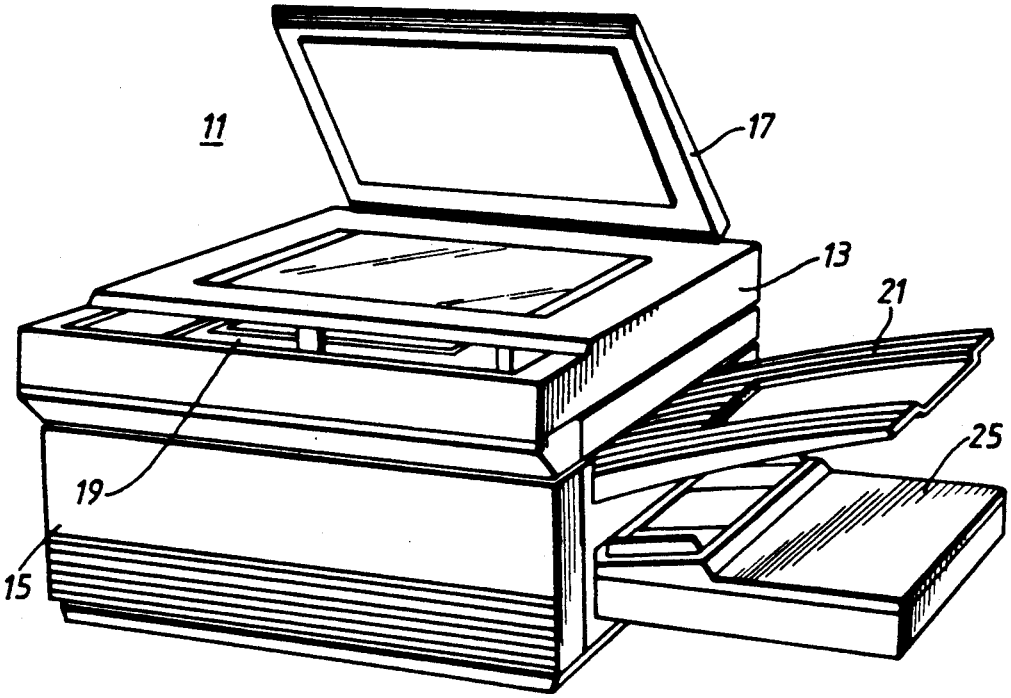
FIG. 1 is a perspective view of an image forming apparatus according to one embodiment of this invention.

Referring now to FIG. 1, a copying machine 11 includes a scanner unit 13 for reading the image of a document. Scanner unit 13 is mounted on a printing unit 15. Printing unit 15 prints an image of the document read by scanner unit 13 on a paper sheet. A cover 17 for covering the document on an original table of scanner unit 13 and an operating panel 19 are disposed on the upper portion of scanner unit 13. Through operating panel 19 a plurality of information is inputted to a controller (see FIG. 4).

A discharging tray 21 and a cassette 25 are disposed on the side of printing unit 15. Cassette 25 stores a plurality of paper sheets for printing the image of the document. The printed paper sheet is discharging onto discharging tray 21.

Scanner unit 13 includes an image sensor e.g., CCD, for transforming reflected light from the document to an signal each line. The image sensor is moved from one edge of the document to the other edge of the document. The signals corresponding to the image of the entire surface of the document are sent to printing unit 15.

Figure 2:
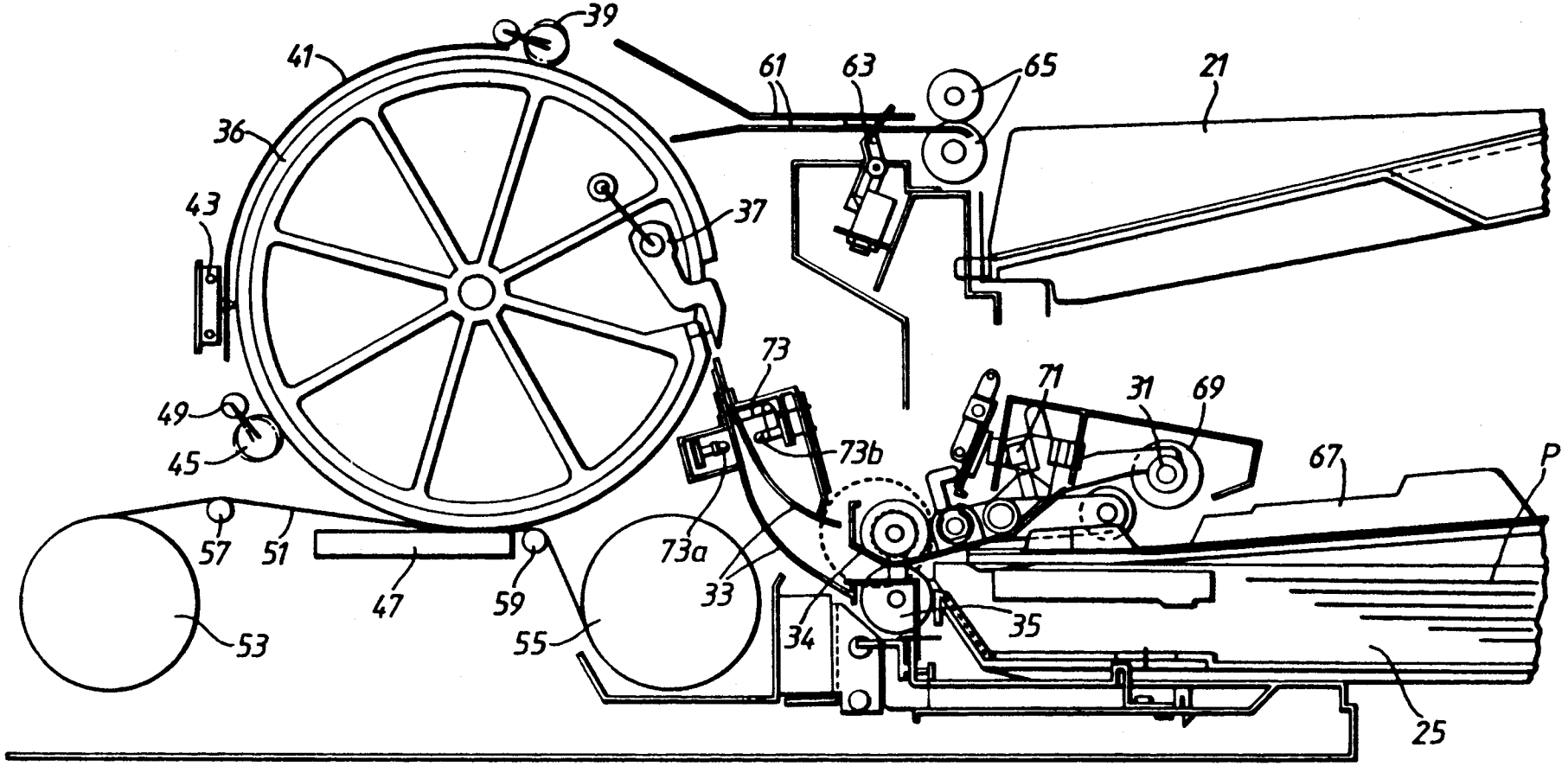
FIG. 2 is a cross sectional view of a printing unit which forms part of the image forming apparatus shown in FIG. 1.

Referring now to FIG. 2, the detailed of printing unit is as follows:

Cassette 25 includes a plurality of paper sheet P. The paper sheet P is picked up by a pick-up roller 31. In response to operation of the copy starting switch, pick-up roller 31 is caused to come into contact with the top paper sheet P in cassette 25. The picked paper P is fed to a feeding guide 33 by a feeding roller 34 and a separating roller 35. Feeding roller 34 is rotated clockwise in FIG. 2. Separating roller 35 is rotated counterclockwise. If a plurality of paper sheets P are picked up to feeding roller 34, all paper sheets except one are moved back to cassette 25.

The picked, or fed, paper sheet P is transported onto the surface of a drum 36. Drum 36 includes a gripper 37 for gripping the fed paper sheet P. Drum 36 with the gripped paper sheet P is rotated counterclockwise. The gripped paper sheet P is retained to drum 36 by a discharging roller 39, a guide 41 provided along the about a quarter of the surface of drum 36, a sensor 43 provided at the end of guide 41, and a pinch roller 45. Furthermore, the fed paper sheet P is transported to an array means, such as a thermal head 47. Gripper 37 does not obstruct the insertion of the paper sheet P into between drum 36 and thermal head 47, because gripper 37 with the paper sheet P forms a portion of the surface of drum 36.

Sensor 43 detects the length of the paper sheet P. Pinch roller 45 pushes the paper sheet against the surface of drum 36, by action of a solenoid 49.

Thermal head 47 is located at the bottom of drum 36. An ink ribbon 51 is interposed between drum 36 and thermal head 47. Ink ribbon 51 is fed from a ribbon roll 53 and is taken up by a take-up roller 55 through ribbon guides 57 and 59.

In printing, thermal head 47 presses ink ribbon 51 and the paper sheet P against the surface of drum 36. After printing the image, drum 36 is caused to rotate clockwise. At the same time, discharging roller 39 is caused to move away from the surface of drum 36 so that the printed paper sheet P moves away from drum 36 to a discharging guide 61 as drum 36 is caused to rotate clockwise.

The paper sheet P is caused to run against a switch 63 for detecting the discharging the paper sheet P. In response to the detection of switch 63, gripper 37 is caused to release the paper sheet P. The released paper sheet P is discharged onto tray 21 from drum 36 through a discharging roller 65.

Above cassette 25 is provided a manual feeding guide 67 for guiding the manual fed paper sheet P. The manual fed paper sheet P is picked up by a manual-feed-pick-up roller 69. Manual-feed-pick-up-roller 69 is caused to pick up in response to the detection of the manually fed paper sheet P by a switch 71.

A plurality of kinds of sheet material may be inserted in manual feed guide 67. For example, a sheet for an over head projector (hereafter referred to as an OHP sheet) may be used. The OHP sheet is distinguished by an OHP sensor 73. OHP sensor 73 includes a light emitting device **73*a* and a light receiving device 73*b*. OHP sensor 73** distinguishes the OHP sheet by the difference of transmittance.

Figure 3:
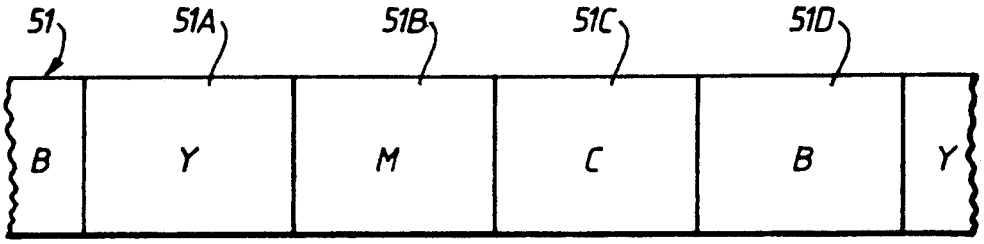
FIG. 3 is a plan view showing an ink ribbon used in the printing unit shown in FIG. 2.

Referring now to FIG. 3, ink ribbon 51 has color ink areas which are of substantially the same size as a sheet of the paper and are sequentially arranged. For example, the color ink areas include yellow (Y) ink area 51A, magenta (M) ink area 51B, cyan (C) ink area 51C and black (BK) ink area 51D. When a color image is printed, the four color ink areas are used and drum 36 is caused to rotate counterclockwise a plurality of times corresponding to the number of colors of ink ribbon 51 which are used.

An image, scanned by scanner 13, is printed on the paper in ink of yellow ink area 51A, and the paper is set back to the print starting position after the image forming process by ink of yellow ink area 51A is completed. In this state, the image is printed in ink of magenta area 51B. After this, in the same manner as described above, the paper is set back to the print starting position each time the image is printed in one color ink and the image is printed in ink of cyan ink area 51C or black ink area 51D. The printing operation will be described later in detail.

Figure 4:
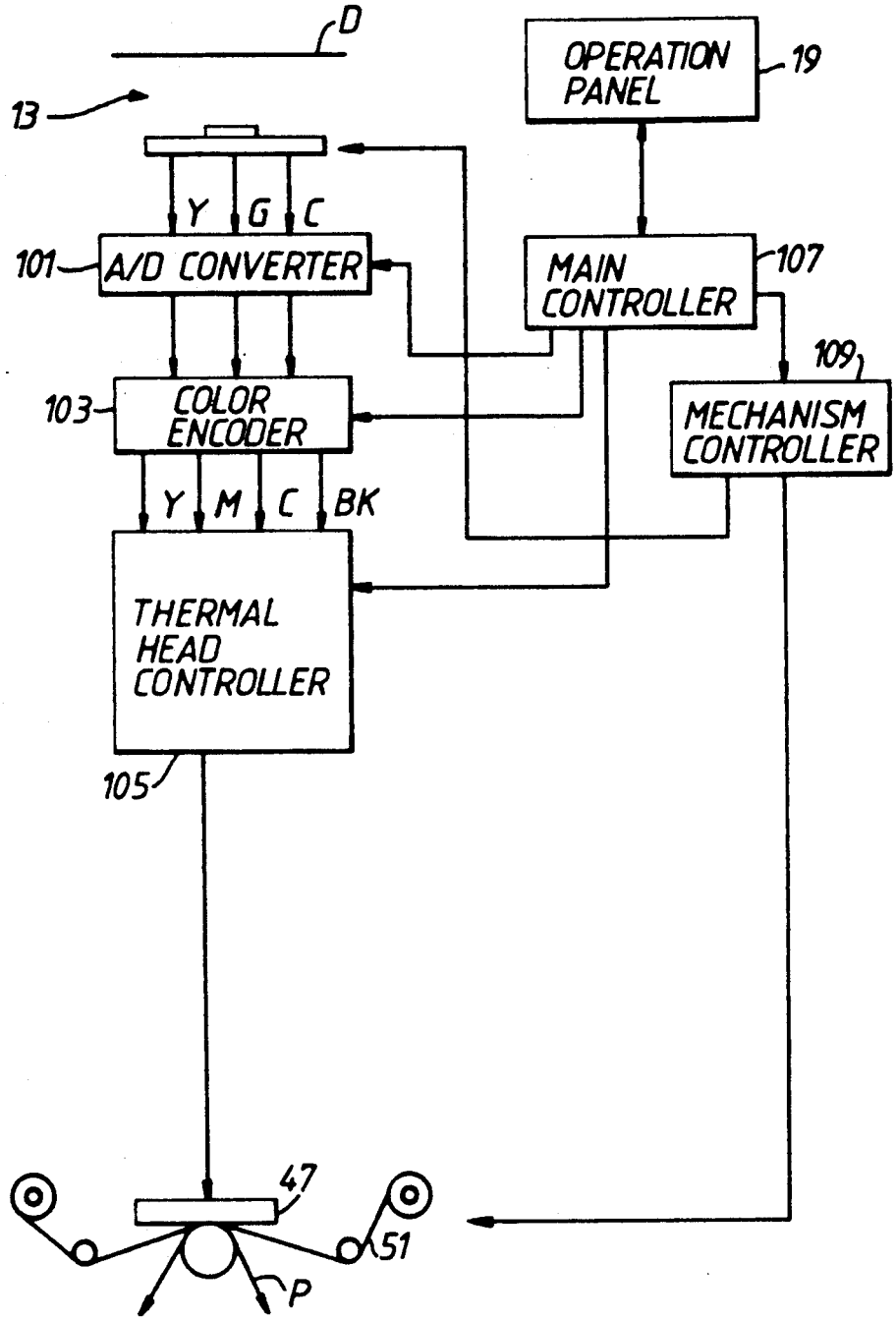
FIG. 4 is a block diagram showing a control system which forms part of the image forming apparatus.

Referring now to FIG. 4, a control system of the copying machine 11 includes an A/D converter 101 which converts an analog image signal output from scanner unit 13 into a digital image signals. The analog image signals from scanner 13 are produced by a photoelectric converter, e.g., CCD elements with color filters of Y (yellow), G (green), and C (cyan).

The digital output signals Y, G, and C from A/D converter 101 are inputted to a color encoder 103. Color encoder 103 converts the output data Y, G and C from scanner 13 into color component signals Y, M, C and BK (black) of four colors. Color encoder 103 is required to convert the color image signal produced by the scanner unit 13 to a color image signal compatible with thermal head 47, because the outputs from CCD elements of scanner 13 and the color inks of ink ribbon 51 are based on the different color mixture principles. The outputs from CCD elements are based on the additive color mixture principle, whereas the color inks of ink ribbon are based on the subtractive color mixture principle.

The encoded digital signals Y, M, C and BK are input to a thermal head controller 105. Thermal head controller 105 converts the encoded signals Y, M, C and BK into driving signals for the thermal head 47. A/D converter 101, color encoder 103, and thermal head control 105 are controlled by a main controller 107, e.g., a CPU. Scanner unit 13 and printing unit 15 are controlled by mechanism controller 109, which is also controlled by main controller 107.

Figure 5:
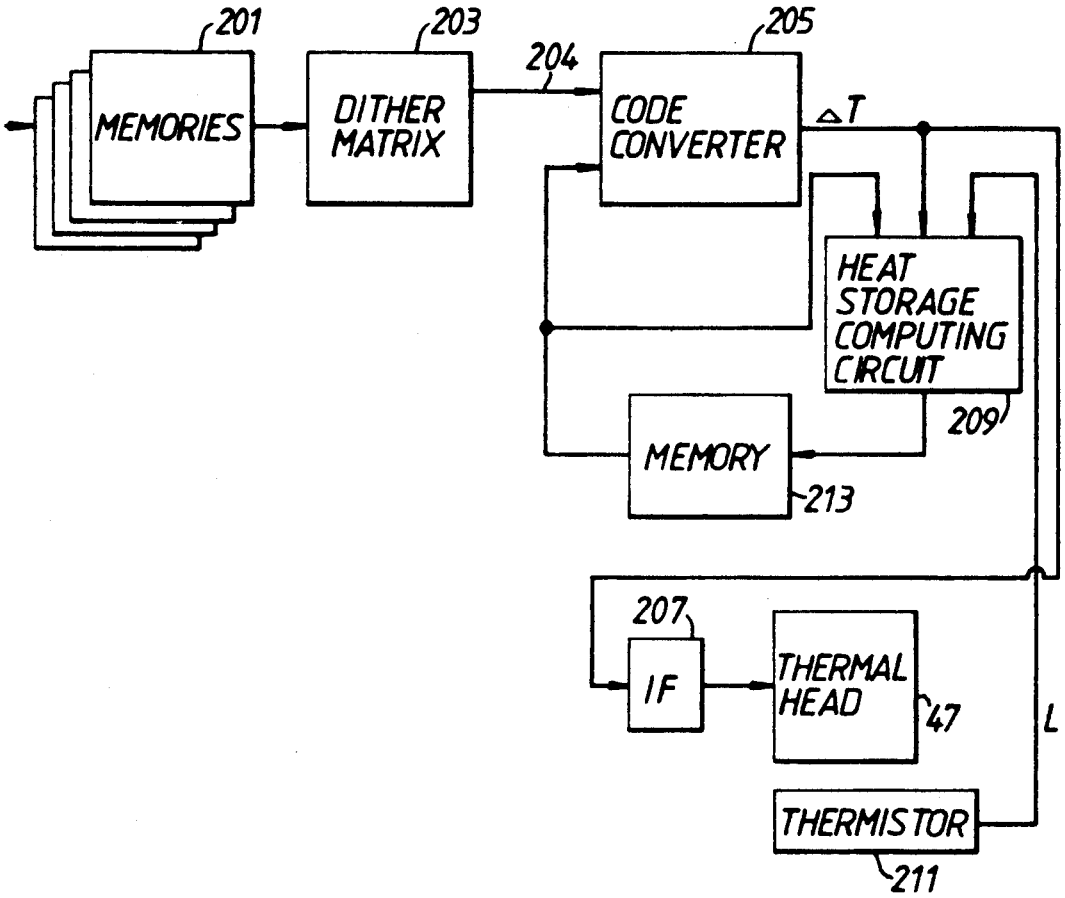
FIG. 5 is a block diagram showing a thermal head controller which forms part of the control system shown in FIG. 4.

Referring now to FIG. 5, the detail of thermal head controller 105 is as follows:

The encoded signals Y, M, C and BK are respectively stored in a separate memory 201. The capacity of each unit memory 201 is that corresponding to one page of image signal.

The stored signals in each memory 201 are sequentially inputted to a driving means, such as a dither matrix circuit 203. Dither matrix circuit 203 converts digital image density signals into digital signals for driving the components of the printing unit 15. Dither matrix circuit 203 includes a read-only memory (hereafter referred to as ROM), e.g., 512K byte capacity. This ROM stores one or a plurality of dither matrices based on a dither technique method. Dither matrix technique are well known to those skilled in the art, as taught, for example, in "An optimum method for two-level rendition of continuous pictures", by B. E. Bayer in ICC '73, Conf. Rec., published June 1973. Accordingly, dither matrix technique will not be described in detail.

Figure 6:
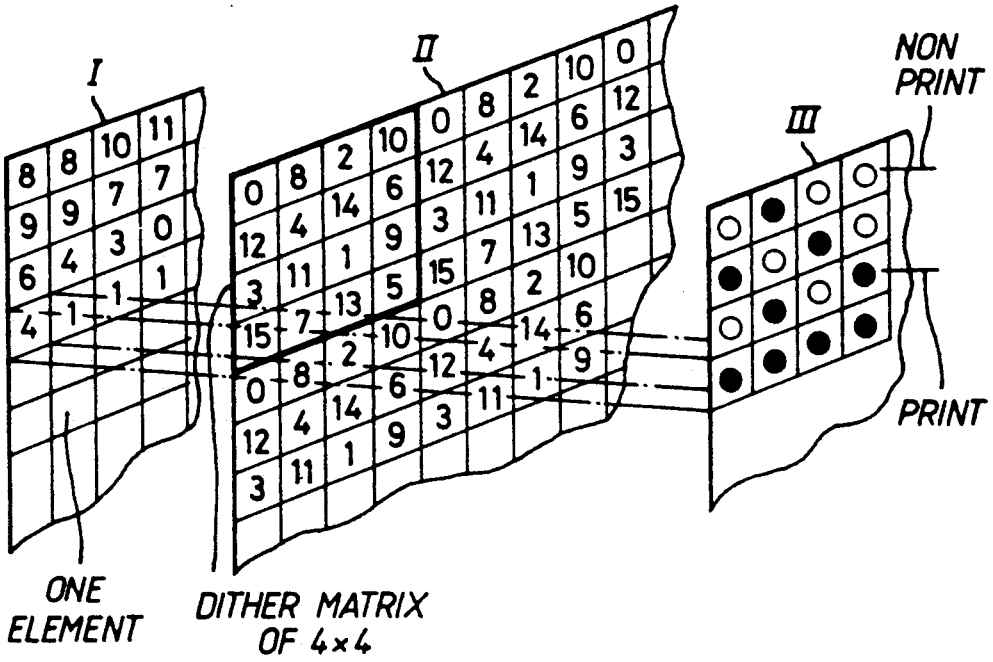
FIG. 6 is a schematic view illustrating the dither matrix technique used in the thermal head control system shown in FIG. 5.

Referring now to FIG. 6, the dither matrix is made of a plurality of columns and rows, e.g., in units of $4\times4$ elements. For each element a threshold level is assigned. The levels I of color signals of the document (obtained from memories 201) are respectively compared with the different threshold levels II stored in the $4\times4$ dither matrix. On the basis of the result of the comparison, binary signals III, representing printing or nonprinting, are generated, thus providing a dot pattern as shown in FIG. 6. The binary dither technique as described above is suitable for some applications. An improved dither method is disclosed in U.S. patent application Ser. No. 056,763 filed June, 2, 1987.

Figure 7:
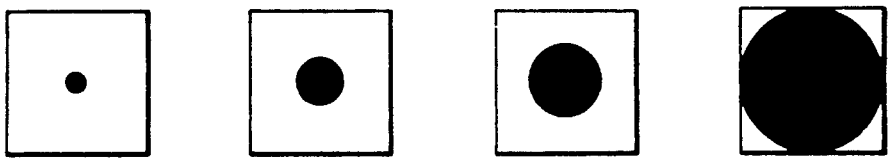
FIG. 7 is and illustration for explaining the thermal printing method used in the printing unit shown in FIG. 2.

According to the method of the aforementioned U.S. patent application, signals III are not binary, but multivalued. Referring now to FIG. 7, the size of the printed dot is variable. For the higher level I of color signals, the size of the printed dot is made larger. To achieve the multivalued dot size, the energy supplied to thermal head 47 is varied. In the present embodiment, the energy is supplied in the form of a pulse with a variable width. The pulse is formed of combinations of a plurality of basic pulse widths. furthermore, the combination of pulse widths is represented by a code in order to decrease the quantity of information required to be processed.

In the present embodiment, 8 basic pulses are employed in various combinations. That is, basic pulse width of "26", "260", "308", "360", "412", "464", "516" and "934" units are used. Each unit is 0.25 μsec. For example, 26 units means 6.5 μsec. (=26×0.25). The relation between the code and the pulse width is shown in TABLE 1. The pulses with 0 through 3280 width are represented by 128 numbers. For example, code 30 means a pulse width of 776 (=516+260) units.

As described above, dither matrix circuit 203 converts the image density signal into a code representing the pulse width.

Referring now to FIG. 5 again, the code representing pulse width (indicated as 204 in FIG. 5) is inputted into a code converter 205 for modifying the code based on the amount of heat stored in thermal head 47. The modified code, designated ΔT, is inputted into thermal head 47 through an interface 207. Interface 207 converts the code representing pulse width into a pulse signal having a width corresponding to the code.

The modified code is also inputted to a predicting means, such as a heat storage computing circuit 209. Heat storage computing circuit 209 estimates the amount of heat stored in thermal head 47 after a pulse having a width designated by the present code is supplied to thermal head 47. Circuit 209 uses the modified code from code converter 205 and a temperature value measured by a thermister 211. Specifically, heat storage computing circuit 209 estimates how much heat will remain stored in thermal head 47 at the time of the next printing. The estimated heat value is stored in a memory 213 at each printing cycle. Memory 213 thus contains a thermal history of thermal head 47. Heat storage computing circuit 209 may estimate a temperature on thermal head 47. This can be easily obtained by dividing the estimated heat storage by a thermal capacity of thermal head 47.

TABLE 1

| CODE | PULSE WIDTH |
|---|---|
| 0 | 26 |
| 1 | 26 |
| 2 | 26 |
| 3 | 26 |
| 4 | 26 |
| 5 | 26 |
| 6 | 260 |
| 7 | 260 |
| 8 | 260 |
| 9 | 260 |
| 10 | 260 |
| 11 | 286 |
| 12 | 308 |

TABLE 1-continued

| CODE | PULSE WIDTH |
|---|---|
| 13 | 334 |
| 14 | 360 |
| 15 | 386 |
| 16 | 412 |
| 17 | 438 |
| 18 | 464 |
| 19 | 490 |
| 20 | 516 |
| 21 | 542 |
| 22 | 568 |
| 23 | 594 |
| 24 | 620 |
| 25 | 646 |
| 26 | 672 |
| 27 | 698 |
| 28 | 724 |
| 29 | 750 |
| 30 | 776 |
| 31 | 802 |
| 32 | 824 |
| 33 | 850 |
| 34 | 876 |
| 35 | 902 |
| 36 | 928 |
| 37 | 954 |
| 38 | 980 |
| 39 | 1006 |
| 40 | 1032 |
| 41 | 1058 |
| 42 | 1084 |
| 43 | 1110 |
| 44 | 1136 |
| 45 | 1162 |
| 46 | 1188 |
| 47 | 1214 |
| 48 | 1240 |
| 49 | 1266 |
| 50 | 1294 |
| 51 | 1320 |
| 52 | 1340 |
| 53 | 1366 |
| 54 | 1392 |
| 55 | 1418 |
| 56 | 1444 |
| 57 | 1470 |
| 58 | 1496 |
| 59 | 1522 |
| 60 | 1548 |
| 61 | 1574 |
| 62 | 1602 |
| 63 | 1628 |
| 64 | 1652 |
| 65 | 1678 |
| 66 | 1706 |
| 67 | 1732 |
| 68 | 1758 |
| 69 | 1784 |
| 70 | 1810 |
| 71 | 1836 |
| 72 | 1862 |
| 73 | 1888 |
| 74 | 1914 |
| 75 | 1940 |
| 76 | 1960 |
| 77 | 1986 |
| 78 | 2014 |
| 79 | 1040 |
| 80 | 2066 |
| 81 | 2092 |
| 82 | 2118 |
| 83 | 2144 |
| 84 | 2170 |
| 85 | 2196 |
| 86 | 2222 |
| 87 | 2248 |
| 88 | 2274 |
| 89 | 2300 |
| 90 | 2326 |
| 91 | 2352 |
| 92 | 2478 |

TABLE 1-continued

| CODE | PULSE WIDTH |
|---|---|
| 93 | 2404 |
| 94 | 2430 |
| 95 | 2456 |
| 96 | 2478 |
| 97 | 2504 |
| 98 | 2530 |
| 99 | 2556 |
| 100 | 2582 |
| 101 | 2608 |
| 102 | 2634 |
| 103 | 2660 |
| 104 | 2686 |
| 105 | 2712 |
| 106 | 2738 |
| 107 | 2764 |
| 108 | 2790 |
| 109 | 2816 |
| 110 | 2842 |
| 111 | 2868 |
| 112 | 2894 |
| 113 | 2920 |
| 114 | 2946 |
| 115 | 2972 |
| 116 | 2994 |
| 117 | 3020 |
| 118 | 3020 |
| 119 | 3020 |
| 120 | 3020 |
| 121 | 3020 |
| 122 | 3254 |
| 123 | 3254 |
| 124 | 3254 |
| 125 | 3254 |
| 126 | 3254 |
| 127 | 3280 |

The stored data is inputted to code converter 205 and heat storage computing circuit 209 after the stored data is read from memory 213. Code converter 205 modifies the code, using the amount of the estimated heat stored in thermal head 47 so that the width designated by the code is caused to be narrower if the temperature of thermal head 53 is rising or is caused to be wider if the temperature of thermal head 47 is falling.

Heat storage computing circuit 209 estimates the amount of heat stored in thermal head 47 after printing as follows:

By using the measured temperature, the modified code, and the amount of the estimated heat stored in memory 213, heat storage computing circuit 209 estimates the amount of heat stored at the start time of the next printing cycle. The modified code represents a pulse width which will be supplied to thermal head at the present printing cycle. The amount of estimated heat read from memory 213 is estimated by heat storage computing circuit 209 as the amount of stored heat after the pulse is supplied in the last printing cycle. That is, the amount of the estimated stored heat read from memory 213 is the heat stored in thermal head 47 at the start time in the present printing cycle.

Figure 8:
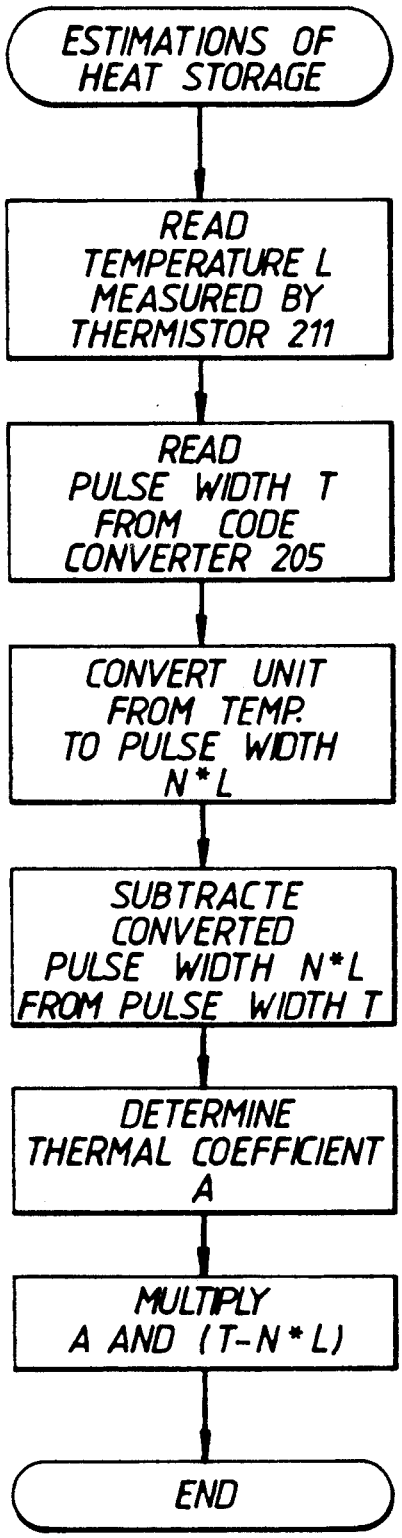
FIG. 8 is a flow chart illustrating an estimating steps carried out by a heat storage computing circuit shown in FIG. 5.

Referring now to FIG. 8, the estimating steps of heat storage computing circuit 209 will be detailed.

Inputs to heat storage computing circuit 209 includes the temperature L measured by thermister 211, the estimated stored heat computed at the last printing cycle, and the modified code ΔT. The temperature L measured by thermister 211 is inputted from thermister 211. The estimated heat storage computed at the last printing cycle is read from memory 213. The modified code ΔT is read from code converter 205. The estimated stored heat T of thermal head 47 is obtained by following equation:

$$T=A(\Delta T-N^{*}L)$$

where $A=A_1{}^{*}\{$(the saturated temperature during the supply of the energy) −(the estimated present temperature)$\}$ L is the temperature measured by thermister 211.

$A_1$ and N are conversion coefficients from the unit of temperature to that of energy.

Furthermore, it is noted that a thermal coefficient A is a function of the inputted energy and the estimated temperature, corresponding to the estimated stored heat, so that the thermal coefficient A is varied for each computation of T. The derivation of the above equation will be detailed hereafter.

Figure 9A:
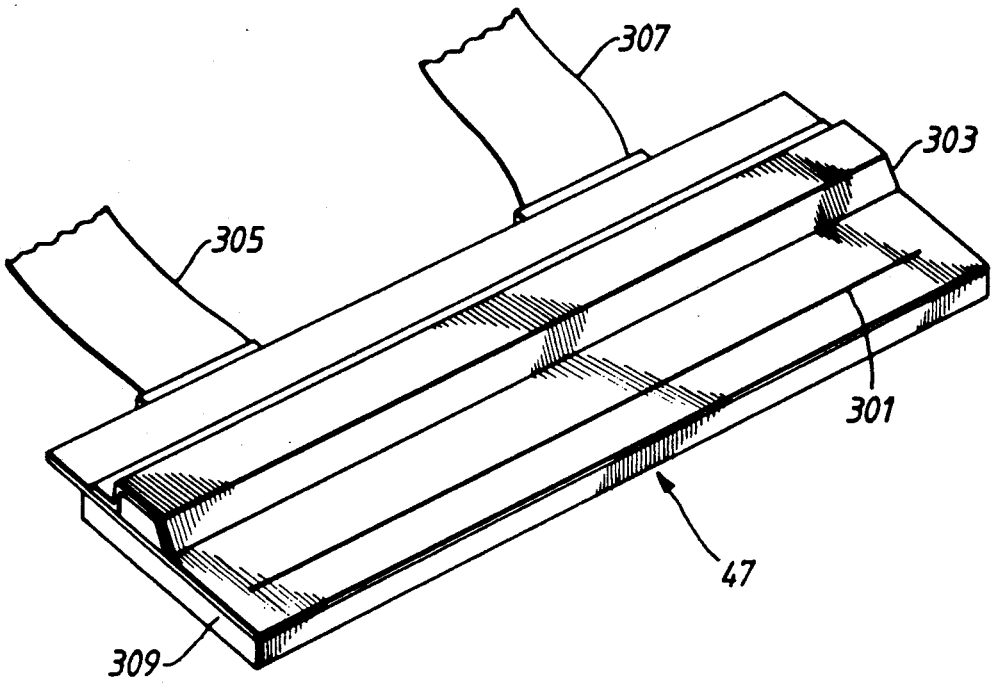
FIG. 9A is a perspective view of a thermal head used in the printing unit shown in FIG. 2.

Before the derivation of the above equation, thermister 211 and thermal head 47 are described as follows:

Referring now to FIG. 9A, thermal head 47 includes a line of heat generating elements 301 which are provided on a ceramic body 303. Heat generating elements 301 are connected with interface 207 through connectors 305 and 307. Under ceramic body 303 is provided a heat sink 309 for radiating heat from thermal head 47.

Figure 9B:
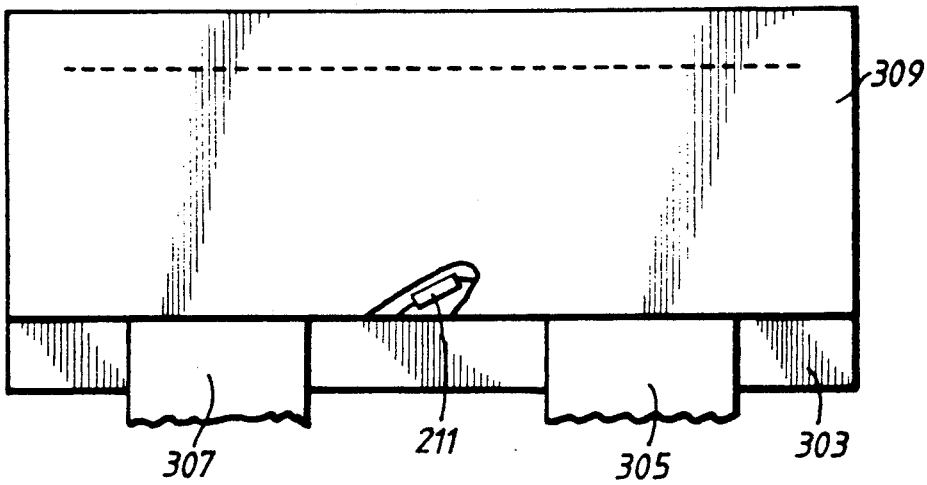
FIG. 9B is a rear view of the thermal head shown in FIG. 9A.

Referring now to FIG. 9B, thermister 211 is connected with ceramic body 303 at a connecting portion. A portion of ceramic body 303 at the connecting position is removed so that ceramic body 303 is exposed at the connecting position. It is desirable that thermister 211 be located on heat generating elements.

Figure 10:
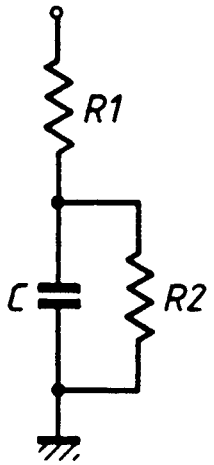
FIG. 10 is a circuit diagram equivalent to a heat condition of the thermal head shown in FIG. 9A.

FIG. 10 shows a thermal equivalent circuit for thermal head 47. A thermal resistance $R_1$ and a thermal capacitor C are connected in series. A thermal resistance $R_2$ is connected in parallel with both ends of capacitor C. Resistance $R_1$ represents the heat radiation of heat generating elements 301. Capacitor C represents the heat capacity of thermal head 47, mainly of heat sink 309. Resistance $R_2$ represents a heat radiation from thermal head 47, mainly from heat sink 309.

This equivalent circuit is a variation of a well known R-C circuit. In an electrical analog, a voltage $V_1$ in capacitor C in a charging cycle and a voltage $V_2$ in capacitor C in a discharging cycle are calculated as follows:

$$V_1=V_1'^{*}(1-e^{-\alpha t}) \quad (1)$$

$$V_2=V_2'^{*}e^{-\alpha t} \quad (2)$$

where $V_1'$ and $V_2'$ are initial values.

$$\alpha=\frac{R1+R2}{CR_1CR_2}$$

The total stored heat T is calculated as a subtraction of a heat radiation R from a heat storage S after a time t, since heat generating elements 301 are caused to produce heat. The heat storage S is equivalent the voltage $V_1$ in the charging cycle for the equivalent circuit shown in FIG. 10. The heat radiation R is equivalent to the voltage $V_2$ in the discharging cycle for the equivalent circuit shown in FIG. 10.

$$T = R + S = V_1 - V_2 = v_1' * (1 - e^{-at}) - V_2' e^{-at} \quad (3)$$

A quadratic approximate expansion equation of T is as follows;

$$T_A = a(\Delta t)^2 - b(\Delta t) + C - d(\Delta t)^2 + f(\Delta t) + g = (a - d)(\Delta t)^2 - (b - f)(\Delta t) + (c + g) \quad (4)$$

Furthermore, this approximate expansion equation of T may be expressed by a differential of $T_A$ in an infinitely small time $\Delta t$ as follows:

$$T(\Delta) = TA' = 2(a - d)\Delta t - (b - f) = A(\Delta t - B) \quad (5)$$

where $$A = 2(a - d)$$

$$B = (b - f)/A$$

a, b, c, d, f and g are coefficients determined by an initial condition. $\Delta t$ may be considered to be the pulse width of a pulse which is supplied to the heat generating elements. This is because the pulse width is assumed to be infinitely small. The pulse width is on the order of $\mu$sec. The time for the temperature to be measured is more than one sec.

Equation (5) may be interpreted as follows:

$\Delta t$ means substantially the inputted energy. From equation (5), it is observed that the total heat storage T equals the subtraction of B from the inputted energy. It may be considered that B means the factor related to the present temperature measured by thermister 211. This is because the total heat storage equals zero if the inputted energy equals the heat capacity corresponding to the present temperature measured by thermister 211.

Furthermore, A may be considered be a thermal coefficient. If A is larger, the total heat storage will be larger. If A is smaller, the total heat storage will be smaller. It may be supposed that A should equal the subtraction of the present temperature estimated by heat storage computing circuit 209 from the saturated temperature during the supply of the energy by the pulse. This is because the stored heat will be larger as the saturated temperature is larger than the present temperature estimated by heat storage computing circuit 209.

Based on the above analysis, equation (5) may be rewritten as follows:

$$T(\Delta) = A(\Delta t - N*L) \quad (6)$$

where $A = A_1*\{$(the saturated temperature during the supply of the energy)−(the estimated present temperature)$\}$ L is the temperature measured by thermister 211.

$A_1$ and N are conversion coefficients from the unit of temperature to that of energy.

Code converter 205 modifies the code, corresponding to the pulse width, using the stored heat data as follows:

In the present embodiment, the relation between the estimated stored heat and the code indicating the pulse width has been analyzed. Qualitatively, if the estimated stored heat is larger than a standard value, code converter 205 modifies the code into the new code indicating the narrower pulse width. If the estimated stored heat is smaller than the standard value, code converter 205 modifies the code into the new code indicating the wider pulse width. This modification value is stored in ROM of code converter 205.

The detail of thermal head control circuit 105 will now be described.

Figure 11:
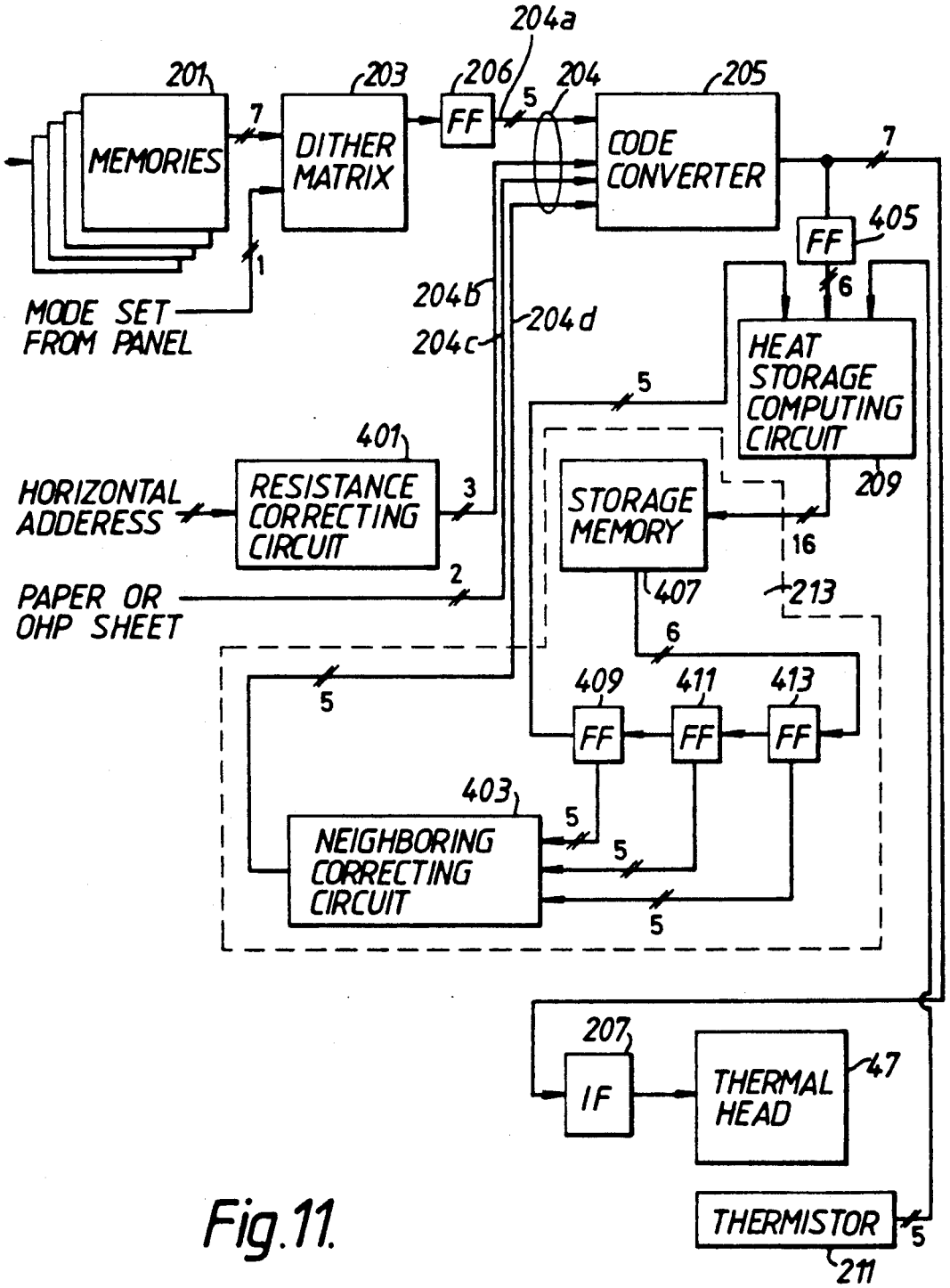
FIG. 11 is a detailed block diagram of the thermal head controller shown in FIG. 4.

Referring now to FIG. 11, two kinds of signals are actually inputted to dither matrix circuit 203. One signal is the image signal from memory 201, consisting of 7 bits. The other is a mode set signal supplied from panel 19, consisting of 1 bit. The mode set signal represents whether the image on the document D is half tone or sharp edged. A dither matrix operation is performed when the mode set signal indicates a half tone image. If the mode set signal indicates a sharp edged image, a comparator (not shown) is selected. The comparator compares the inputted image signal with a threshold. In the present embodiment, the dither matrix and the comparator are each constructed by a ROM. Two kinds of signals are used as an address of ROM the which stores the content of the dither matrix and the comparing result.

This ROM stores signals with 5 bits. The 5 bit signal is supplied through a timing flipflop 206 to code converter 205 as a signal 204*a*. In addition to the 5 bit signal 204*a*, code converter 205 receives a 3 bit signal 204*b* from a resistance correcting circuit 401, a 2 bit signal 204*c* from panel 19, and a 5 bit signal 204*d* from an neighboring correcting circuit 403 which forms a portion of memory 213.

Resistance correcting circuit 401 is made of a ROM with a 64K byte capacity. This ROM stores information about the quality or condition of each heat generating element of thermal head 47. For example, the i-th element may have a slightly lower resistance than the normal value or the j-th element may have a slightly higher resistance than the normal value. In this case, the inputted energy to the i-th element is caused to be larger. The inputted energy to the j-th element is caused to be smaller. This is because the thermal head 47 includes thousands of heat generating elements and it is unavoidable that same variation may occur.

The information stored in ROM of resistance correcting circuit 401 is represented by 3 bit signal 204*b*. That is, the resistance of heat generating elements of thermal head 47 is classified into 8 levels. Using the information stored in resistance correcting circuit 401, code converter 205 modifies the code such that the pulse width become wider if the resistance of a the heat generating element is lower and a pulse width become narrower if the resistance of the heat generating element is higher.

Neighboring correcting circuit 403 is made of ROM with a 512K byte capacity. This ROM stores the information about how to correct the pulse width considering the pulse widths of pulses supplied to the present and the neighboring elements in the last printing line. Qualitatively, if the energy supplied to the neighboring elements has been larger, the present element of thermal head 47 stores more heat.

Furthermore, if a difference of pulse width to be inputted between the neighboring elements is larger, the effect on the present element of heat stored in neighboring elements is larger. For example, if the present and the neighboring elements received pulses with the same width, the same amount of heat was generated so that the neighboring element may not have any effect on the present element in the present printing line. If the present element received a pulse with a very narrow width and the neighboring element has recently received a pulse with a very wide width, heat stored in the neighboring element may significantly effect the present element.

Heat stored in the present element including the effect by the neighboring element is represented by 5 bit signal 204*d*. Receiving the 5 bit signal 204*d* from neighboring correcting circuit 403, code converter 205 modifies the code such that a pulse width become wider if the effect of neighboring elements for the present element is smaller or a pulse width become narrower if the effect of neighboring element for the present element is larger.

Code converter 205 outputs the modified code ΔT with 7 bits, which is supplied to interface 207 and heat storage computing circuit 209 through flip-flop 405. Flip-flop 405 neglects the least significant bit from the received signal and outputs the 6 bit signal. In addition to the 6 bit modified code ΔT, heat storage computing circuit 209 receives the 5 bit signals from thermister 211 and a flip flop 409.

Heat storage computing circuit 209 outputs a 16 bit signal which indicates the heat stored at the present heat generating element after the pulse designated by the modified code is supplied to the present element to produce heat for a printing operation. This 16 bit signal is stored in memory 213. Memory 213 includes a storage memory 407 for storing the 16 bit signals outputted by heat storage computing circuit 209. Storage memory 407, however, outputs the stored signal with 6 bits. These 6 bit signals are inputted into neighboring correcting circuit 403 through flip-flops 409, 411, and 413. Flip-flop 409, 411, and 413 function as a type of shift register, and output 5 bit signals neglecting the least significant bit. Owing to the bit configuration as above, the computing of the stored heat is very accurate and the computing of neighboring effect is easily performed.

Figure 12:
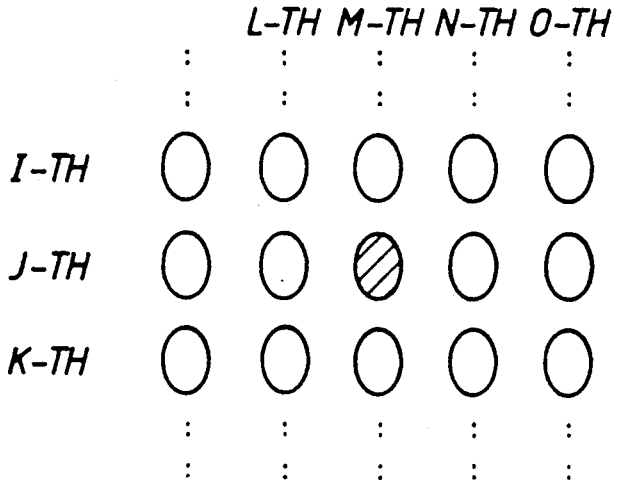
FIG. 12 is an illustration showing an example of the operation of flip-flop which forms part of the thermal head controller shown in FIG. 11.
Figures 13A, 13B, 13C:
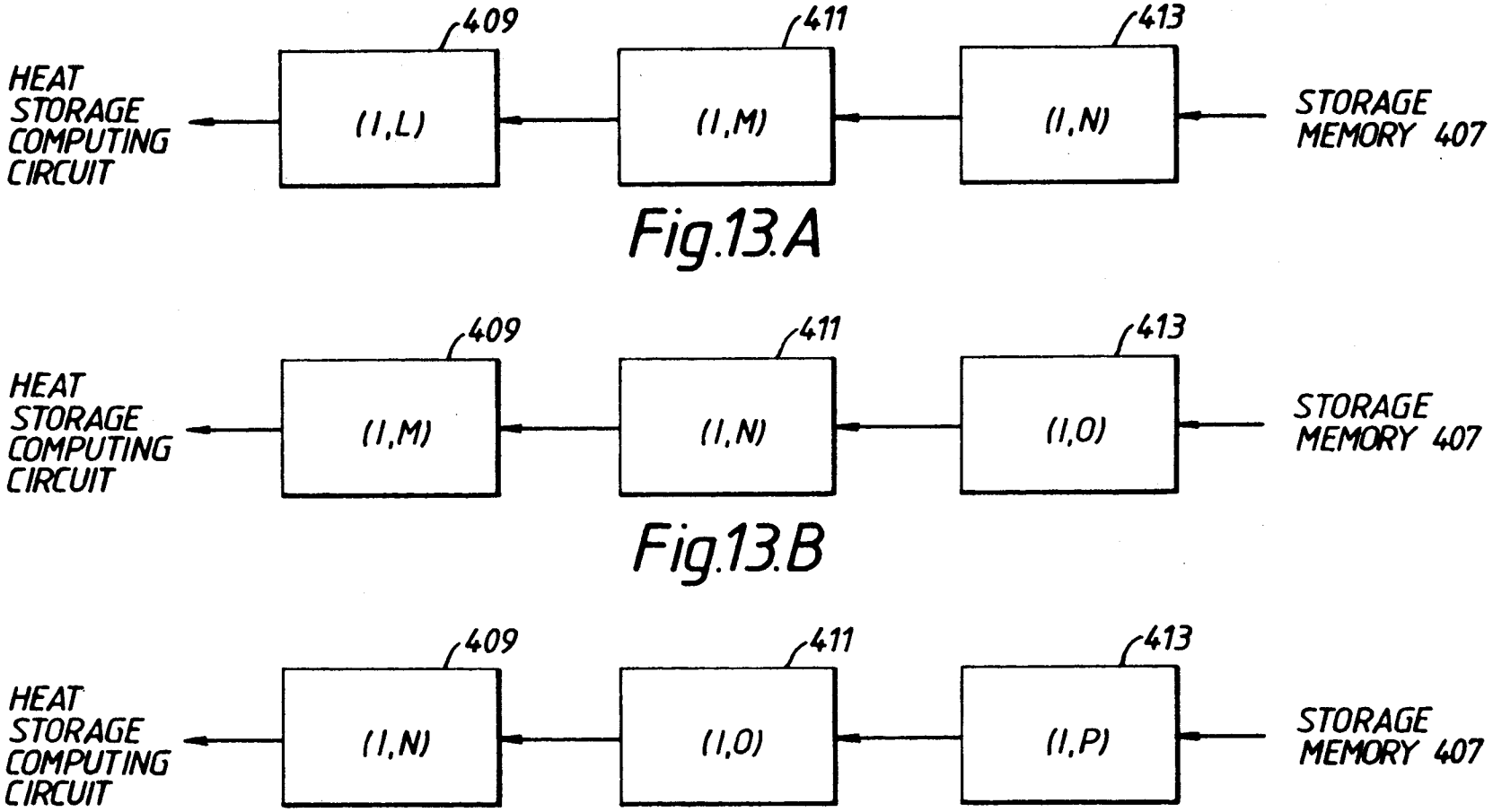
FIGS. 13A through 13C show the changing of the contents of flip-flops which forms part of the thermal head controller shown in FIG. 11.

Referring now to FIG. 12, let the element of the j-th row and m-th column be called the element (J, M) in a printing area. It is supposed that this element (J,M) is the present element to be printed. Storage memory 407 already stores the estimated heat storage corresponding to the element of the j-th row. The j-th line is the last printing line. Before the code is converted from the output of dither matrix circuit 203, the estimated heat storage corresponding to the elements (I, L), (I, M), and (I, N) were stored in flip-flops 409, 411 and 413 respectively as shown in FIG. 13A. After one operating clock in thermal head controller 105, neighboring correcting circuit 403 outputs the signal including the effect of neighboring elements toward code converter 205. At the same time, the next succeeding data is read from ROM of storage memory 407 and supplied to flip flop 413. That is, the estimated stored heat corresponding to the elements (I, M), (I, N), and (I, O) are now stored in flip-flops 409, 411, and 413 respectively as shown in FIG. 13B.

As described above, code converter 205 is made in a ROM. The output of neighboring correct circuit 403 is used as the reading address of the ROM of code converter 205. After one operating clock, the modified data is read from ROM of code converter 205. At the same time, the next succeeding data is read from the ROM of storage memory 407. That is, the estimated stored heat corresponding to the elements (I, N), (I, O), and (I, P) are now stored in flip-flops 409, 411, and 413 respectively, as shown in FIG. 13C. The last stored data in flip-flop 409, (I,M) is outputted to heat storage computing circuit 209.

At this time, heat storage computing circuit 209 receives three inputs; that is, the modified code corresponding to the element (J,M), the estimated stored heat corresponding to the element (I,M) and the detected temperature of thermal head 47 detected by thermister 211. Heat storage computing circuit 209 outputs the estimated stored heat corresponding to the element (J,M).

Figure 14:
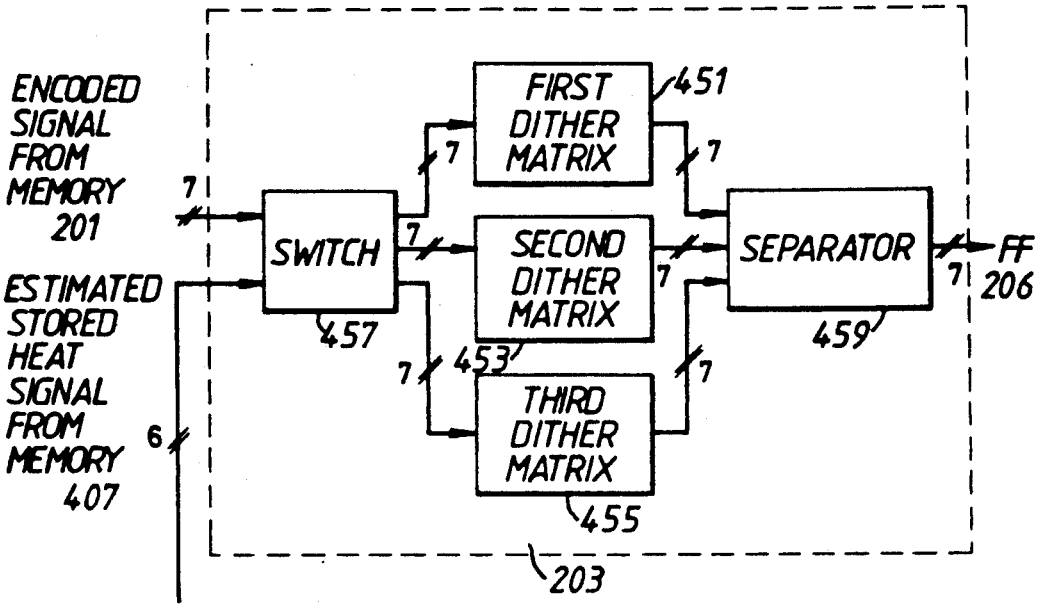
FIGS. 14 and 15 are block diagrams of a thermal head controller of the other embodiments of the invention.

FIG. 14 shows another preferred embodiment of the invention. The difference between the first and the present embodiment is that dither matrix 203 is varied according to the estimated stored heat.

Dither matrix circuit 203 includes a plurality of dither matrices, e.g., a first dither matrix 451 for normal temperature, a second dither matrix 453 for high temperature, and a third dither matrix 455 for low temperature. An estimated stored heat signal, which is representative of an estimated heat stored in thermal head 47, is supplies to a switch 457 from storage memory 407. Switch 457 decides which dither matrices is used in accordance with the estimated stored heat signal. Switch 457 supplies the encoded signal from memories 201 to one of first, second, or third matrix 451, 453, or 455 according to the estimated heat. The output of one of first, second, or third matrix 451, 453, or 455 is supplied to flip flop 206 through a separator 459. Separator 459 outputs the received signal to flip flop 206. If the estimated stored heat is extremely large or small such that code converter 205 fails to sufficiently modify the code considering the high or small (considering a negative) stored heat, the second or the third dither matrix 453 or 455 is selected. Actually, a plurality of dither matrices are constructed by the ROM. The output of storage memory 407 is used as one portion of address for the ROM of dither matrix circuit 203.

Figure 15:
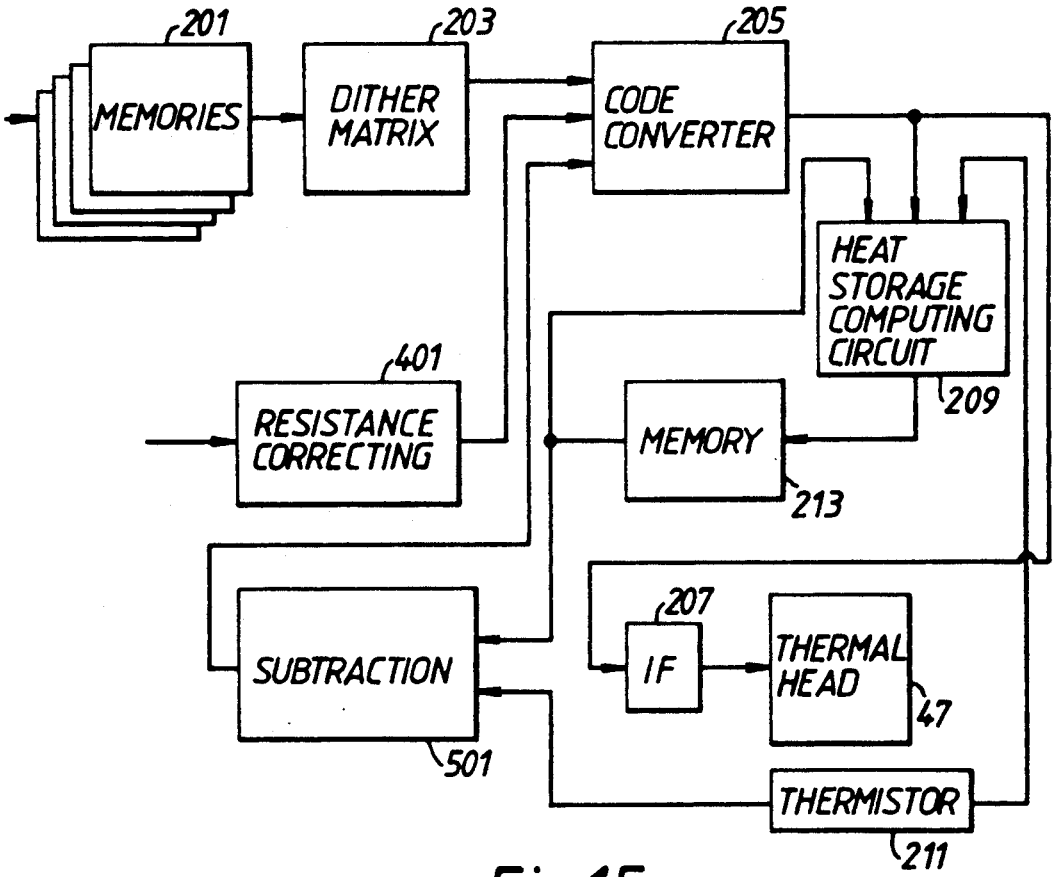

Referring now to FIG. 15, another preferred embodiment of the present invention will be described as follows;

The difference between the foregoing embodiments and the present embodiment is the construction of code converter 205.

The read address of ROM of code converter 205 includes the image signal from dither matrix circuit 203, the signal from resistance correction circuit 401, and the signal from a subtraction circuit 501. Subtracting circuit 501 subtracts the temperature measured by thermister 211 from the estimated temperature. The estimated temperature is obtained from the the estimated stored heat using a total heat capacity of thermal head 47. This subtraction indicates a thermal condition, e.g., rising or falling of temperature. If the temperature is rising, the code is modified into the new code indicating the narrower pulse width. If the temperature is falling, the code is modified into the new code indicating the wider pulse width. The degree of the modification of pulse width according to the subtraction of the temperature measured by thermister 211 from the estimated temperature is determined by an experiment.

For example, the above modification is restricted to the intermediate range of the image density. If the subtraction of the temperature measured by thermister 211 from the estimated temperature is positive, code converter 205 converts the code into the new code which equals the subtraction of 3 from the old code. If the subtraction of the temperature measured by thermister 211 from the estimated temperature are negative, code converter 205 converts the code into the new code which equals the sum of 3 and the old code.

What is claimed is:

1. A thermal printing apparatus for generating heat to produce an output image according to an input image, comprising:

driving means for supplying a driving signal corresponding to the input image;

a thermal head comprising a base and a heating element array on the base, responsive to an input signal, for generating heat to produce the output image;

generating means for generating a temperature signal representative of a temperature of the base;

predicting means, for generating an estimated stored heat signal representative of an estimated stored heat in the heating element array based on the combination of the temperature signal and the driving signal; and controlling means, responsive to the driving signal and the estimated stored heat signal, for generating the input signal.

2. The apparatus according to claim 1, wherein the predicting means includes means for generating the estimated stored heat signal based on the temperature signal, the input signal, and an immediately previously estimated stored heat signal in the heat element array generated by the predicting means in the immediately previous printing.

3. The apparatus according to claim 1, wherein the predicting means includes:

first subtracting means for subtracting an energy corresponding to the temperature of the base from an energy corresponding to the input signal; and second generating means for generating the estimated stored heat signal in the heating element array after the driving means supplies the driving signal based on the subtracted energy.

4. The apparatus according to claim 3, wherein the second generating means includes:

second subtracting means for subtracting the estimated temperature corresponding to the estimated stored heat from a saturated temperature during the supply of the input signal; and means for multiply the subtracted estimated temperature and the subtracted energy.

5. The apparatus of claim 1, wherein the controlling means includes means for adjusting a pulse width of the input signal responsive to the estimated stored heat.

6. The apparatus of claim 1, further comprising means for producing the driving signal from a signal representing a density of the image.

7. The apparatus of claim 6, wherein the input signal is in the form of a pulse and the producing means varies the driving signal in response to the estimated stored heat.

8. A process for supplying an input signal to a thermal device which emits heat to produce an output image representative of an input image, the process comprising the steps of:

producing a driving signal corresponding to an image density of the input image;

generating a temperature signal representative of a temperature of the thermal device;

generating, an estimated stored heat signal representative of heat stored in the thermal device based on a combination of the temperature signal and the driving signal; and generating the input signal in accordance with the estimated stored heat signal and the driving signal.

9. The process of claim 8, wherein the the estimated stored heat generating step includes the steps of:

subtracting an energy corresponding to the temperature of the thermal device from an energy corresponding to the input signal; and generating the estimated stored heat signal in the thermal device after the input signal is supplied to the thermal device from the subtracted energy.

10. The process according to claim 8, wherein the estimated stored heat generating step includes the steps of:

subtracting an energy corresponding to the temperature of the thermal device from an energy corresponding to the input signal;

subtracting the estimated temperature corresponding to the estimated stored heat from a saturated temperature during the supply of the input signal; and multiplying the the subtracted estimated temperature and the subtracted energy.

11. A thermal printing apparatus for generating heat to produce an output image in a plurality of printing cycles according to an input image, comprising:

driving means for supplying a driving signal corresponding to the input image;

a thermal head comprising a base and a heating element array on the base, responsive to an input signal, for generating heat to produce the output image;

generating means for generating a temperature signal representative of a temperature of the base;

predicting means for generating an estimated stored heat signal representative of an estimated stored heat in the heating element array based on the combination of the temperature signal and the driving signal, and, in a subsequent printing cycle, for further generating the estimated stored heat signal based on the input signal, and a last estimated stored heat signal generated by the predicting means in a preceding printing cycle; and controlling means, responsive to the driving signal and the estimated stored heat signal, for generating the input signal.

* * * * *